US005626367A

United States Patent [19]

Lu

[11] Patent Number: 5,626,367

[45] Date of Patent: May 6, 1997

[54] LOOSE LEAF BINDER

[76] Inventor: Steven Lu, No. 33, Jui-Chu Rd., Fengshan, Kaohsiung Hsien, Taiwan

[21] Appl. No.: 275,263

[22] Filed: Jul. 15, 1994

[51] Int. Cl.[6] ..... B42D 1/00

[52] U.S. Cl. ..... 281/21.1; 281/15.1; 281/28

[58] Field of Search ..... 281/21.1, 15.1, 281/42, 45, 51, 28

[56] References Cited

U.S. PATENT DOCUMENTS 4,949,997 8/1990 Champagne ..... 281/45

5,031,936 7/1991 Vannier ..... 281/21.1

5,104,147 4/1992 King ..... 281/21.1

*Primary Examiner*—Willmon Fridie

*Attorney, Agent, or Firm*—Larson and Taylor

[57] ABSTRACT

A loose leaf binder includes a number of binding elements each having a resilient middle portion, a front portion and a rear portion. The front portion includes a pair of flanges which include protrusions and depressions engageable with each other and engageable with the papers to be bound together so as to secure the papers to the binding elements. The papers can be easily removed and changed by disengaging the flanges. It is not required to disassemble the binding elements.

4 Claims, 5 Drawing Sheets

LOOSE LEAF BINDER

BACKGROUND OF THE INVENTION

1. Field of the Invention

The present invention relates to a binder, and more particularly to a loose leaf binder.

2. Description of the Prior Art

Typical loose leaf binders comprise fasteners, binder rings or binding wire for holding loose leaf papers together so as to form a book, particularly an album. However, normally, when bound together, the papers may not be easily disengaged from the book unless disengaging the fastening elements, such that the papers may not be easily changed.

The present invention has arisen to mitigate and/or obviate the afore-described disadvantages of the conventional loose leaf binders.

SUMMARY OF THE INVENTION

The primary objective of the present invention is to provide a loose leaf binder in which the bound papers may be easily changed.

In accordance with one aspect of the invention, there is provided a loose leaf binder for papers comprising a plurality of first binding elements each including a front portion and a rear portion, the front portion including a pair of flanges, the flanges including engaging means for engaging with the papers so as to secure the papers to the flanges, and means for securing the rear portions of the first binding elements together.

The first flange includes at least two protrusions formed thereon, the second flange includes at least two depressions formed therein for engaging with the protrusions so as to secure the flanges together.

The securing means includes at least two cavities and at least to projections formed in the rear portion of each of the first binding elements for engaging with projections or cavities of other first binding elements.

The securing means includes at least two recesses formed in the rear portion of each of the first binding elements, the recesses each includes a dovetail slot formed therein, at least two dovetail elements are formed in the rear portion for engaging with the dovetail slots so as to secure the first binding elements together.

The loose leaf binder comprises at least one second binding element including a front portion having a pair of second flanges formed therein and including a rear portion, the second flanges including a second engaging means for engaging with the papers, means for securing the rear portion of the second binding element to the rear portions of the first binding elements, and the second binding element including a flap secured thereto for engaging with a cover layer.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
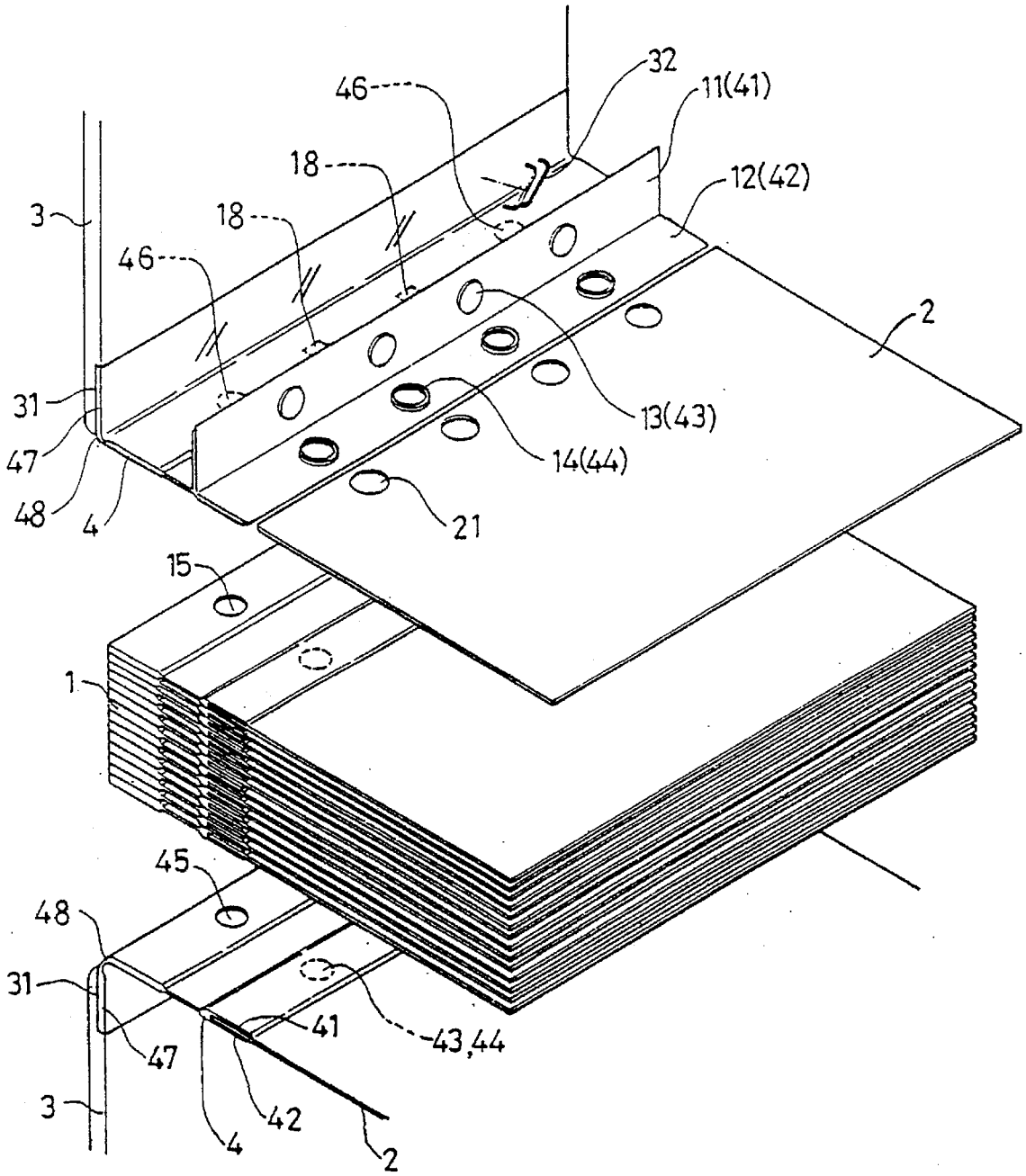
FIG. 1 is an exploded view of a book employing a loose leaf binder in accordance with the present invention.
Figure 2:
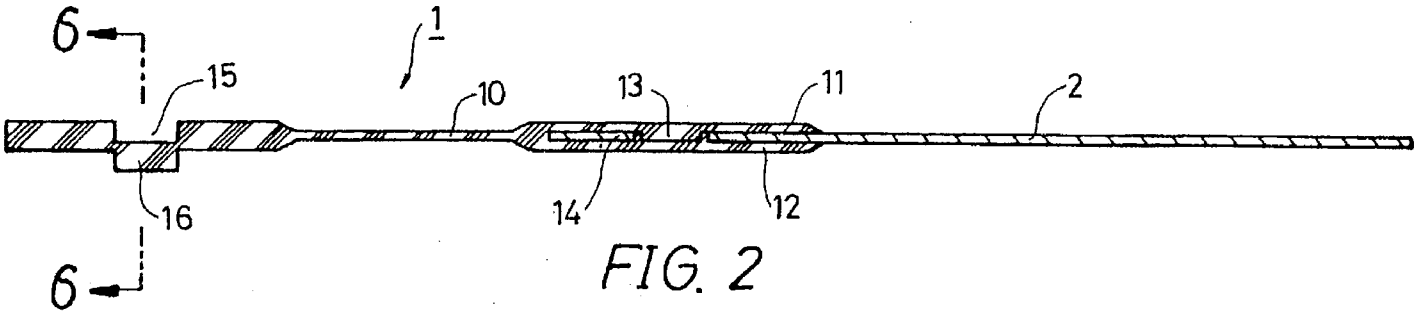
FIG. 2 is a cross sectional view of a binding element.
Figure 3:
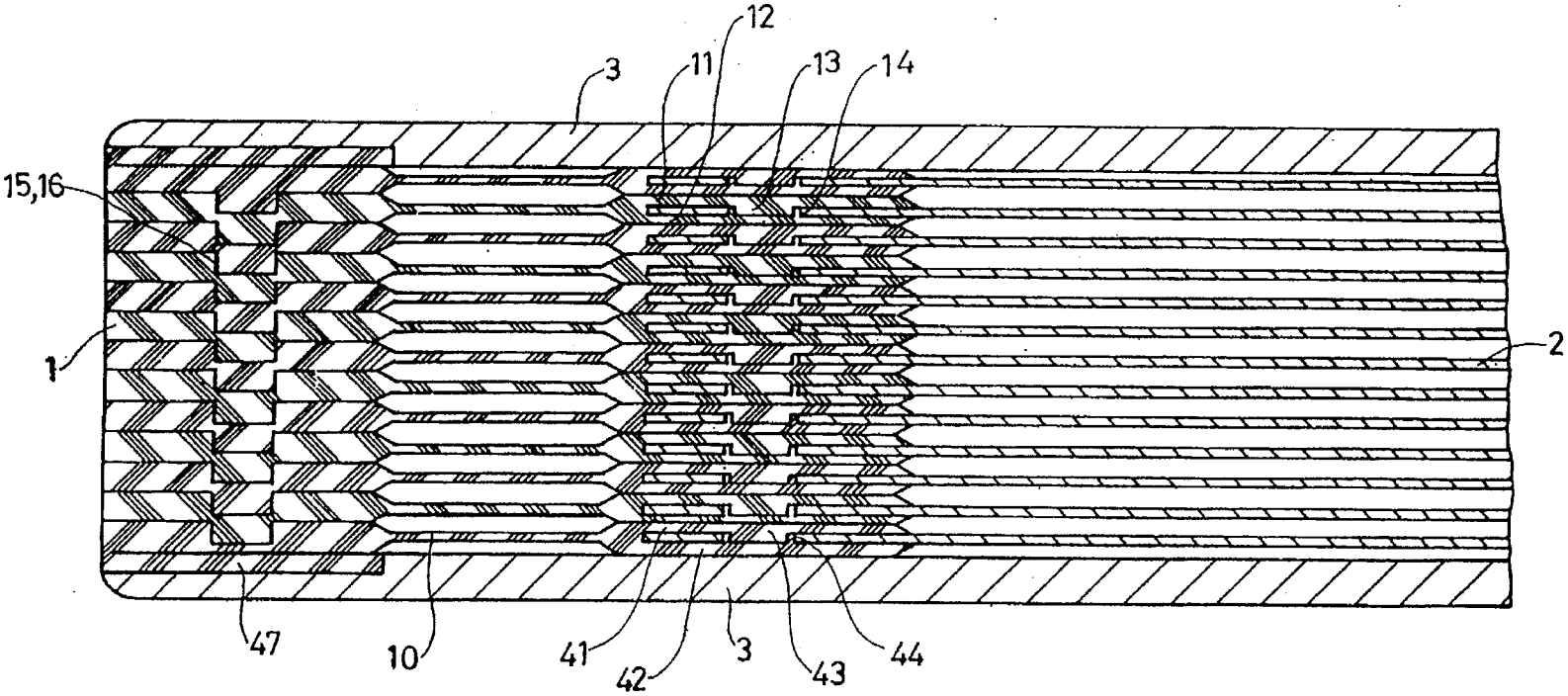
FIG. 3 is a cross sectional view of the book.
Figure 4:
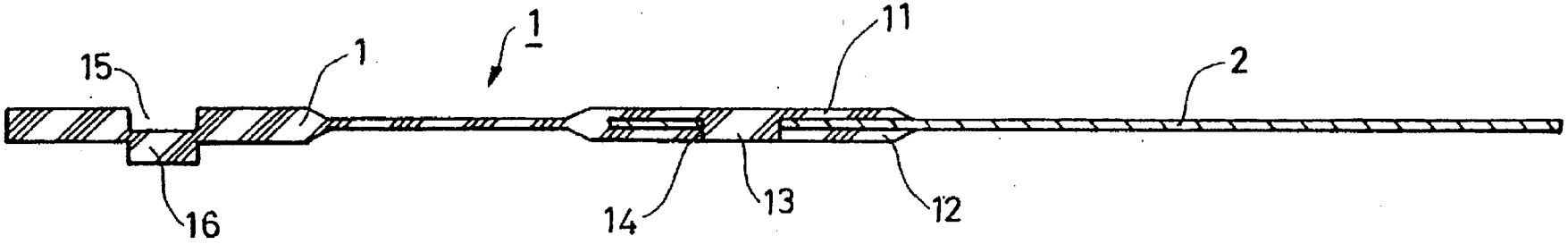
FIG. 4 is a cross sectional view similar to FIG. 2, illustrating another application of the binding element.
Figure 5:
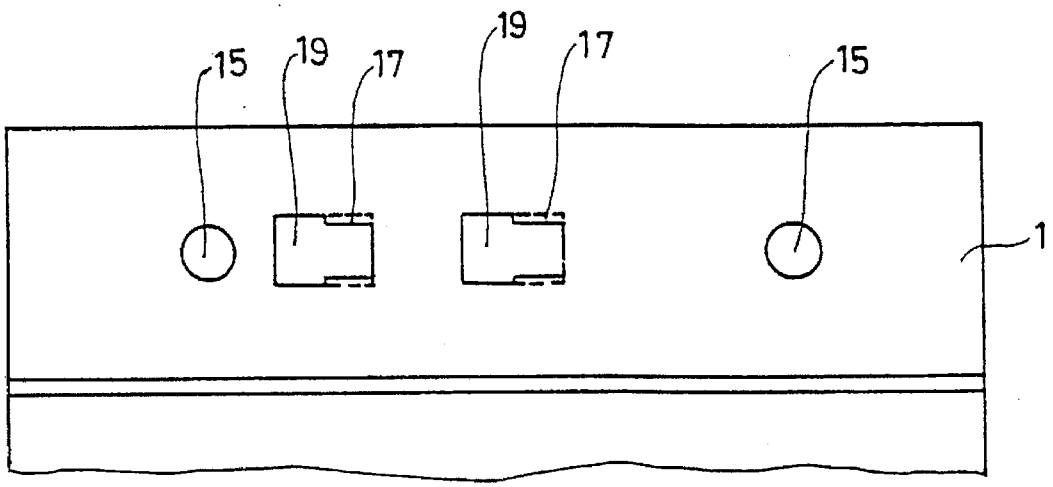
FIG. 5 is a plane view of the binding element.
Figure 6:
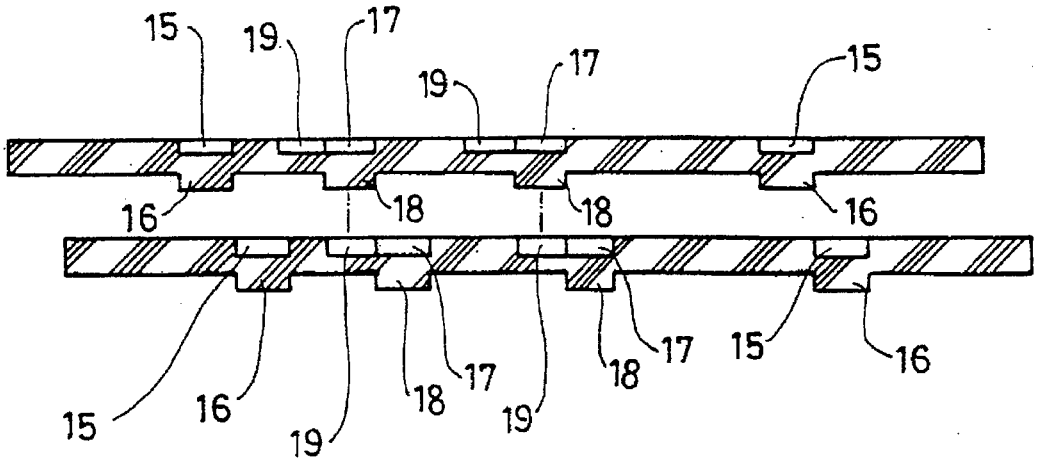
FIG. 6 is a cross sectional view taken along lines 6—6 of FIG. 2, illustrating two binding elements.
Figure 7:
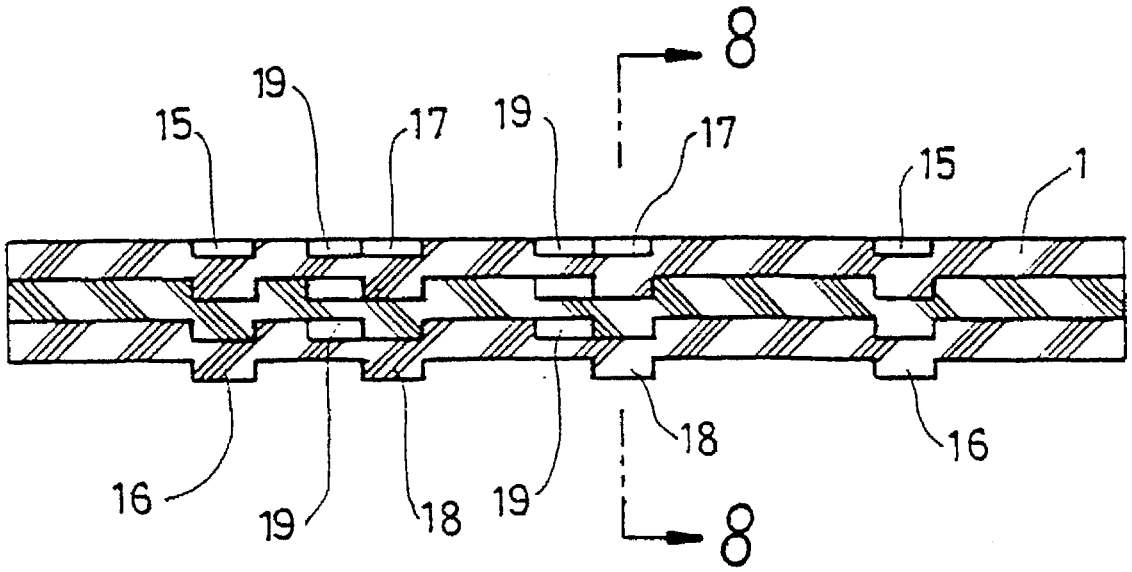
FIG. 7 is a cross sectional view illustrating two binding elements which are coupled together.
Figure 8:
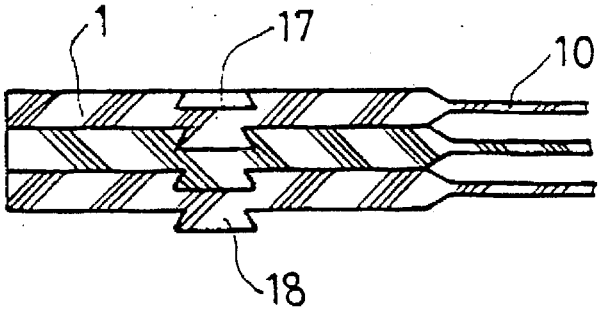
FIG. 8 is a cross sectional view taken along lines 8—8 of FIG. 7.

Referring to the drawings, and initially to FIGS. 1 to 3, a loose leaf binder in accordance with the present invention comprises a plurality of binding elements 1 each including a thinner or resilient middle portion 10 so as to form a front portion and a rear portion. The front portion of the binding element 1 includes a pair of flanges 11, 12, in which the flange 11 includes a number of protrusions 13 formed thereon for force-fitting with a number of depressions or hubs 14 of another flange 12. The papers 2 to be bound together each includes a number of holes 21 for engaging with the protrusions 13 such that the papers 2 may be secured to the binding elements 1. Alternatively, as shown in FIG. 4, the protrusions 13 may be engaged with holes 14 formed in the flange 12.

The rear portion of the binding element 1 includes an upper surface having two cavities 15 formed therein and includes a lower surface having two projections 16 extended therefrom and corresponding to the cavities 15 for engaging with the cavities 15 of other binding elements 1 so as to secure the binding elements 1 together. As best shown in FIGS. 5 to 8, two recesses 19 are formed in the upper surface of the binding element 1 and each includes a dovetail slot 17 formed therein, two corresponding dovetail elements 18 are extended in the lower surface of the binding elements 1 for engaging with the dovetail slots 17 of other binding elements 1 such that the binding elements may further be solidly secured together. The dovetail elements 18 are first engaged within the recesses 19 and are moved inwards of the dovetail slots 17 so as to be engaged in the slots 17.

Referring again to FIGS. 1 and 3, two cover layers 3 may be provided for covering the papers 2. Two further binding elements 4 are provided for securing the cover layers 3 to the binding elements 1. Each of the binding elements 4 also includes a front portion having a pair of flanges 41, 42 formed therein. The flange 41 also includes a number of protrusions 43 for engaging with depressions 44 of the other flange 42 and for engaging with the holes 21 of the papers 2 so as to secure the papers 2 to the binding elements 4. The binding elements 4 also includes cavities 45 and projections 46 for engaging with the projections 16 and the cavities 15 of the binding elements 1 respectively such that the binding elements 4 may be secured to the binding elements 1. The binding element 4 may also includes dovetail elements 18 for engaging with dovetail slots 17 of the binding elements 1 so as to further secure the binding elements 4 and 1 together. Each of the binding elements 4 includes a flap 47 extended therefrom for engaging with depression 31 of the cover layers 3 and secured to the cover layers 3 by adhesive materials and/or staples 32. The flaps 47 are coupled to the binding elements 4 at hinge lines 48 such that the flaps 47 are foldable relative to the binding elements 4.

Accordingly, the loose leaf binder in accordance with the present invention includes a number of binding elements each having a pair of flanges for fixing papers such that the papers may be easily changed without disengaging the binding elements.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A loose leaf binder for papers comprising:

a plurality of first binding elements each including a front portion and a rear portion, said front portion including a first flange and a second flange, said flanges including engaging means for engaging with said papers so as to secure said papers to said flanges;

securing means for securing said rear portions of said first binding elements together; and at least one second binding element including a front portion having a pair of second flanges formed therein and including a rear portion, said second flanges including a second engaging means for engaging with said papers, means for securing said rear portion of said second binding element to said rear portions of said first binding elements, and said second binding element including a flap secured thereto for engaging with a cover layer.

2. A loose leaf binder according to claim 1, wherein said engaging means comprises at least two protrusions formed on said first flange and at least two depressions formed in said second flange for engaging with said protrusions so as to secure said flanges together when said papers are positioned therebetween.

3. A loose leaf binder according to claim 1, wherein said securing means includes at least two cavities and at least two projections formed in said rear portion of each of said first binding elements for engaging with projections or cavities of other first binding elements.

4. A loose leaf binder according to claim 3, wherein said securing means further comprises at least two recesses having dovetail slots formed therein and at least two dovetail projections, both said dovetail slots and said dovetail projections being formed in said rear portion of each of said first binding elements for engaging with slots or dovetail projections of other first binding elements so as to secure said first binding elements together.

* * * * *